United States Patent [19]

Koll

[11] 4,311,902

[45] Jan. 19, 1982

[54] LEAD CALCULATOR FOR MOVING TARGETS

[75] Inventor: Laurel A. Koll, Ruleville, Miss.

[73] Assignee: LeadRite Corporation, Ruleville, Miss.

[21] Appl. No.: 137,460

[22] Filed: Apr. 4, 1980

Related U.S. Application Data

[63] Continuation-in-part of Ser. No. 11,673, Feb. 12, 1979.

[51] Int. Cl.[3] ..... G06C 27/00

[52] U.S. Cl. ..... 235/78 R; 235/88 R

[58] Field of Search ..... 235/70 R–70 C, 235/78 R–78 N, 79.5, 84, 88 R–88 RC, 78 RC; 33/261

[56] References Cited

U.S. PATENT DOCUMENTS

| | | | |
|---|---|---|---|
| 1,421,553 | 7/1922 | Pohl | 33/261 |
| 2,056,469 | 10/1936 | King | 33/261 |
| 2,168,056 | 8/1939 | Bernegan | 235/70 R |
| 2,170,144 | 8/1939 | Kells et al. | 235/70 R |
| 2,285,722 | 6/1942 | Kells et al. | 235/70 R |
| 3,133,353 | 5/1964 | Williams | 33/261 |
| 3,178,824 | 4/1965 | Callshoe | 33/261 |
| 3,374,948 | 3/1968 | McColm | 235/88 R |
| 4,112,583 | 9/1978 | Castilla | 33/261 |
| 4,120,451 | 10/1978 | Stapleton | 235/89 R |
| 4,121,759 | 10/1978 | Merkel et al. | 235/70 A |

*Primary Examiner*—L. T. Hix
*Assistant Examiner*—Benjamin R. Fuller
*Attorney, Agent, or Firm*—Larry S. Nixon

[57] ABSTRACT

A calculating device and a method of use thereof for determining the lead required to shoot a projectile at a moving target such as game including cooperating logarithmic scales with parameter indicia corresponding to the range of the target, the speed and direction of movement of the target, the speed of the projectile and the required lead displayed on a fixed and a slide member. Markers representative of various projectiles are disposed on the projectile velocity scale at locations corresponding to their normal speed and words descriptive of game speed are disposed at appropriate locations along the target speed scale so that calculations may be made by persons not having knowledge of game and projectile speeds in numerical terms. The lead is calculated from a knowledge of the parameters in a two step process of moving one member relative to the other. In accordance with one embodiment of the invention, the scales are arcuately disposed on members which may be rotated about a common axis.

18 Claims, 7 Drawing Figures

LEAD CALCULATOR FOR MOVING TARGETS

BACKGROUND AND BRIEF SUMMARY OF THE INVENTION

This is a continuation-in-part of prior copending application Ser. No. 11,673, filed Feb. 12, 1979, the subject matter of which is incorporated herein by reference.

The invention relates to determining the lead required in shooting a projectile at a moving target and more particularly to a slide calculator for making such a determination.

It is well known that in order to hit a moving target such as skeet or game with a projectile, the projectile must be directed at a point ahead of the target location at the time the projectile is released. For most hunters, it is easier to learn the required distance ahead, rather than the required angle ahead, at which to shoot at a moving target since distances may be more easily estimated by relating them to the size of the target, which is usually known to the hunter. (The term "target" as used herein is intended to describe any moving object, living or inanimate, at which a shooter is aiming and therefore includes game.) The required distance ahead of the target is known as "lead" and the required amount of lead may be calculated from a knowledge of the directed velocity of the target, the directed velocity of the projectile and the distance from the shooter to the target at the time of shooting. The general formula for lead as a function of these variables is quite complex. However, for many applications a good approximation of the lead may be calculated by assuming that the velocity of the target and the projectile remain constant in magnitude and direction and that the distance from the shooter to the target does not change during the time of flight of the projectile. The later approximation is unnecessary if the distance measurement utilized is that from the shooter to the target at the time the projectile reaches the target. With these approximations the lead is given by the following formula:

$$L=[St\times D/Sp]\ \mathrm{SIN}\ \theta$$

where $\theta$ = angle of movement of the target relative to the line of sight (projectile path);

St = target speed;

Sp = projectile speed;

D = distance to target at time of impact; and

L = lead measured perpendicularly to the line of sight.

The distance and angle parameters in this formula are schematically illustrated in FIG. 1. In order that the formula be accurately applied, the shooter must be able to estimate leads for the range of target speeds, target directions, target ranges and projectile speeds which he is likely to encounter. Leads appropriate for different circumstances may be learned with the use of the above formula. However, for many persons, use of the formula may be difficult and overly time consuming. Its direct use requires a knowledge of mathematics which many shooters do not have. Furthermore, while this formula appears to be simple enough, its use requires that all of the speed and distance values be expressed in the same units of speed and distance. However, it is common in the English-speaking nations to think of the speed of a target such as skeet or game in miles per hour, to think of range in yards, and to express firearm velocities in feet per second. A shooter, thinking of speeds and distance in these units of measurement must first convert target speed to feet per second and range to feet, before calculating the lead in units of feet by use of the mathematical formula. This requirement substantially increases the difficulty and time required for the calculation. Another problem in making the calculation is to determine the sine of the angle of movement of the target. Ordinarily such a calculation requires the use of a special table. A further problem in determining lead encountered by many shooters, especially inexperienced game hunters, is to relate the type of motion of game (e.g., walk, trot, run, fly) to a particular speed of the game or to relate the type of projectile being fired (e.g., arrow, shotgun pellets, rifle bullet) to the speed of the projectile. The shooter would ordinarily be required to consult a ballistics chart to determine the speed of a particular shotgun pellet or rifle bullet.

These difficulties may be overcome by use of the present invention. In accordance with the embodiments of the invention, cooperating logarithmic scales with indicia corresponding to the parameters target speed, range, projectile speed, the sine of the angle of movement of the target and lead, are arcuately displayed on a circular slide rule-type device, the particular indicia and scale units being those most commonly known for each parameter. In the three embodiments of the invention shown, the target speed, target range and target direction angle scales are disposed on the fixed member; the projectile speed and lead scales are disposed on the movable slide member. Calculation of required lead is ordinarily accomplished in two slide steps. The target speed is first multiplied by the range and divided by the projectile speed to obtain the required lead assuming that the target direction at impact is perpendicular to the line of sight ($\theta=90°$), as will be more fully explained in the detailed description below. This result is then multiplied by SIN $\theta$ (if $\theta$ is not 90°), to obtain the actual required lead. In this way the required speed may be quickly and easily calculated without any conversion of units or requirements of mathematical knowledge.

The calculation in each of the embodiments may be used in a number of shooting situations. These include game hunting, and skeet or target shooting as well as military applications such as shooting at various moving military targets.

In accordance with another feature of the invention, markers representative of various projectiles for a given general type of commonly used weapon, e.g., bow, shotgun or rifle, are disposed along the projectile velocity scale at locations corresponding to their normal speed, so that the lead requirement for each of these projectiles may be calculated without knowledge of actual projectile speed. The three illustrated embodiments are respectively designed for use in archery, rifle shooting and shotgun shooting. A larger model displaying appropriate scales and indicia for several types of weaponry is also contemplated.

In accordance with still another feature of the invention a verbal description of target (game) speed is disposed at appropriate locations along the target speed scale so that a game hunter need only know the "mode" of movement, that game is, for example, "walking," "trotting," "running," or "flying," in order to be able to calculate (or at least provide a reasonable estimate) of required lead.

In these embodiments as well as in the embodiments disclosed in the prior copending application Ser. No. 11,673, the slide rule may be comprised of two plastic disks of identical diameter rotatably fastened by a centrally located grommet, the scales on the lower disk being visible through clear plastic portions of the upper disk.

BRIEF DESCRIPTION OF THE DRAWING

These and other features and advantages of the invention can be more easily understood from the following more detailed description taken in conjunction with the accompanying drawings in which.

DETAILED DESCRIPTION OF THE PREFERRED EMBODIMENT

Figure 1:
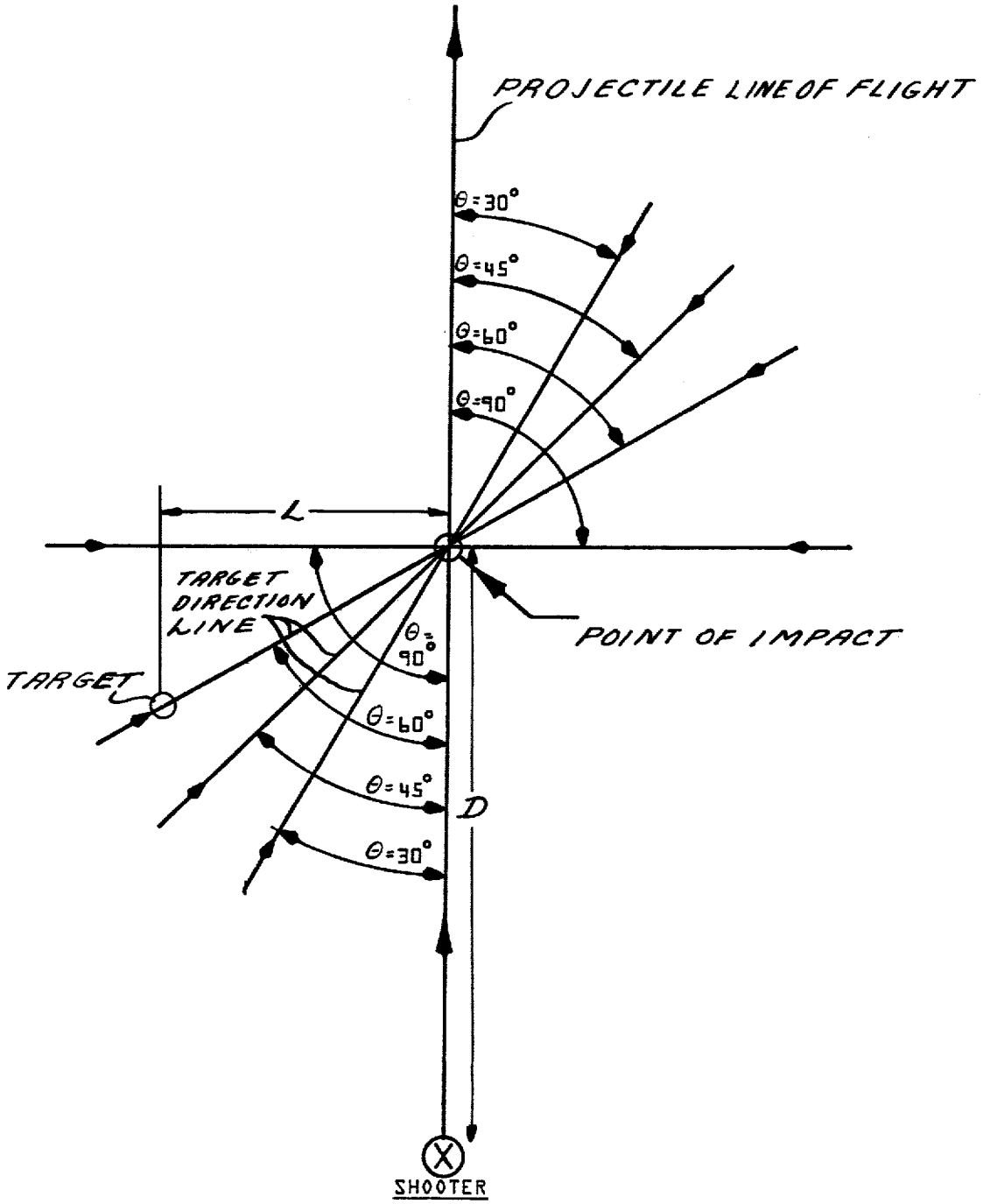
FIG. 1 is a schematic illustration of the distance and angle relationships of the parameters used in the lead formula applied in accordance with the present invention.
Figure 2:
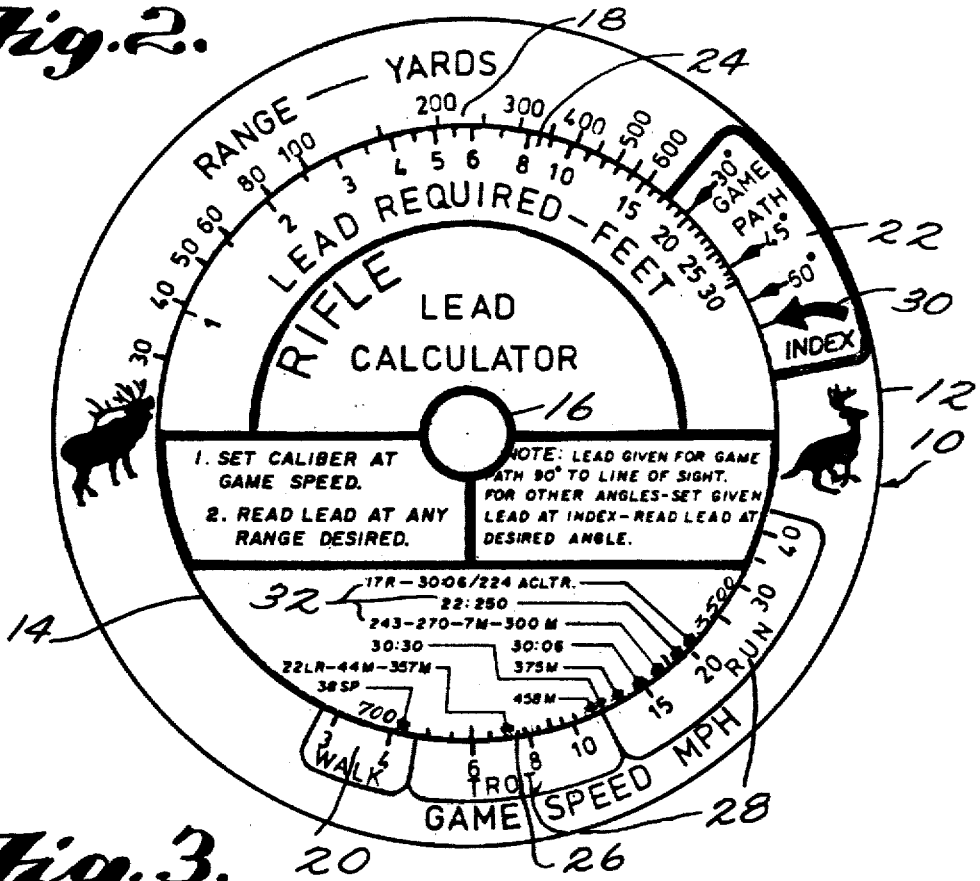
FIGS. 2 and 3 illustrate a method by which the required lead may be calculated using a first embodiment of the invention.
Figure 3:
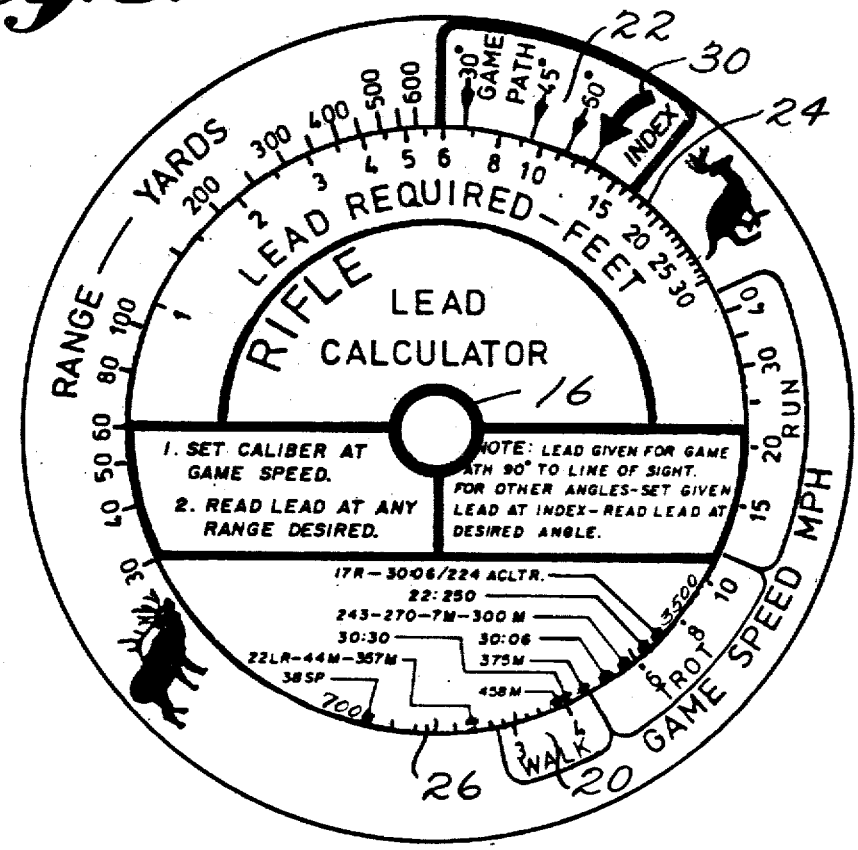
Figure 4:
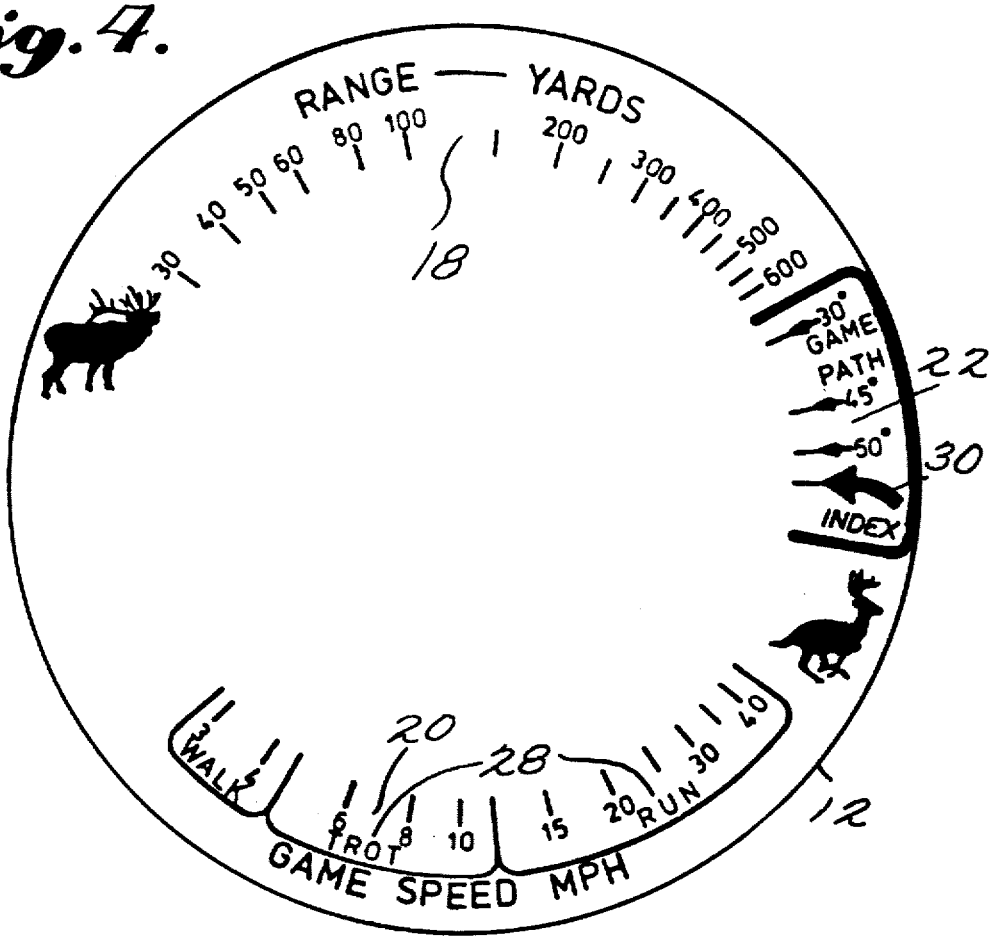
FIG. 4 illustrates the indicia on the fixed member of the first embodiment of the invention.
Figure 5:
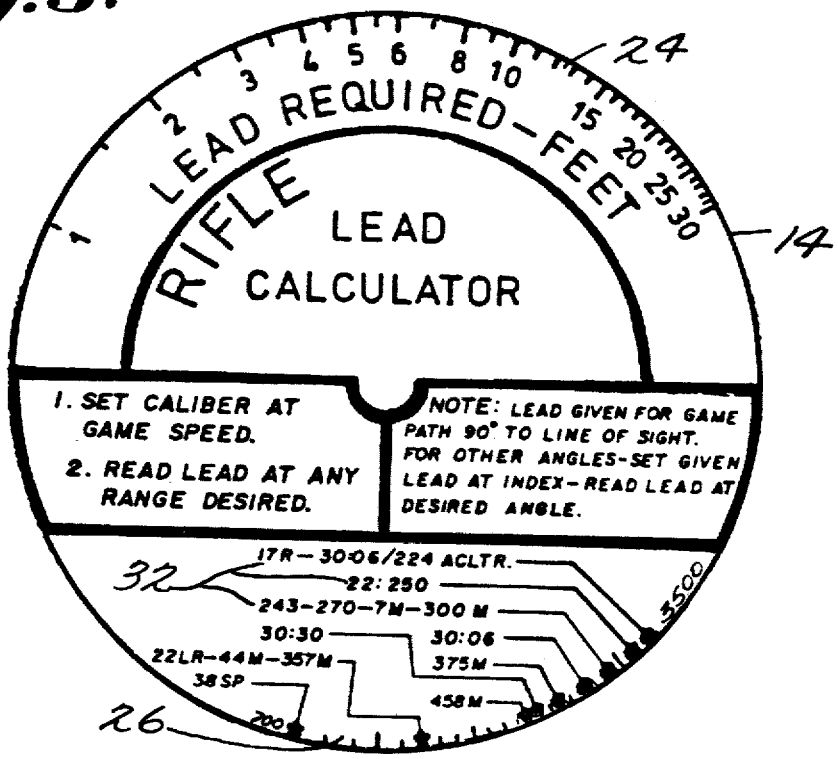
FIG. 5 illustrates the indicia on the slide member of the first embodiment of the invention.

The lead calculator of the present invention particularly adapted for rifle shooting is shown in FIGS. 2 and 3. The lead calculator, generally designated by the numeral 10, has the form of a circular rule comprising a fixed member 12 individually shown in FIG. 4, and slide member 14 individually shown in FIG. 5. Slide member 14 and fixed member 12 have printed scales and indicia disposed thereon and are suitably circular shaped plastic discs concentrically rotatably mounted one above the other at their center by an axle member 16. The term "axle" is defined herein to include any suitable means for rotating two members about an axis. Slide member 14 may have a lesser diameter than fixed member 12 or the two slide members may have the same diameter, the portion of member 14 outside its outermost scale being made of clear plastic so that the scales on the fixed member 12 may be seen therethrough. This latter design protects the printed matter on the fixed member, provides a grasping point at the extreme outer edge of the calculator for moving ther upper slide member 12 relative to the lower fixed member 14. The design has the advantages of a larger moment arm for easier movement, and greater control over the differential in movement, of the upper slide member 12, to more accurately line up the various indicia. It also enables the center axle 16 to be positively set with more friction than conventional calculators to prevent undesirable movement, while still providing extra mechanical advantage over other devices of conventional construction so as to provide easy movement of the members when desired.

A logarithmic scale 18 having indicia corresponding to target range, a logarithmic scale 20 with indicia corresponding to game or target speed and a logarithmic sine scale 22 with indicia corresponding to the angle defining the direction of movement of the game with respect to the line of sight (projectile path) are disposed in circular concentric arcs about axle 16 on fixed member 12. A logarithmic scale 24 corresponding to the speed of the projectile (rifle bullet), and a logarithmic scale 26 with indicia corresponding to required lead, are disposed along circular concentric arcs about axle 16 on slide member 14. The lead scale 26 and projectile scale 24 are suitably disposed just inside the outside circumference of slide member 14 and target speed scale 20 is disposed just outside the circumferential edge of slide member 14.

In order to use calculator 10 to determine the required lead, slide member 14 is slid so that the location on projectile scale 24 corresponding to the projectile speed (measured in feet per second) is aligned with the location on target speed scale 20 corresponding to the target speed (measured in miles per hour). The required lead (measured in feet) for targets moving perpendicularly to the line of sight may then be read on the lead scale 26 adjacent to the location on the range scale 18 corresponding to the range of the target (measured in yards). If the target direction is not perpendicular to the line of sight, the lead is determined by moving slide member 14 so that index marker 30 on direction scale 22 is aligned with the previously determined location on lead scale 26 and the required lead is read on the lead scale adjacent to the location on the direction scale 22 corresponding to the angle defining the direction of movement of the target with respect to the line of sight.

In order to assist those unfamiliar with the normal speed of various rifle bullets used in target shooting and game hunting, word and/or numeric indicia 32 (e.g., caliber) of various rifle bullets are disposed on projectile scale 24 at the locations corresponding to the velocity at which they are ordinarily fired. Such a feature eliminates the requirement of consulting a separate ballistics chart to determine the projectile speed. The scales may be reduced in size and simplified somewhat where only a single projectile type is to be used. The projectile scale may then be reduced to a small range centered at a marker for the normal projectile speed of the particular projectile, the range being provided so that adjustments for variations in the weight of the bullet and other secondary factors may be made.

In order to assist persons unfamiliar with the speed of game in terms of miles per hour, verbal descriptions of the mode of movement 28 are disposed adjacent to particular ranges on target speed scale 20. The descriptive words used in the present embodiment are "walk," "trot" and "run." In carrying out the above described lead calculation procedure, the position on projectile scale 24 corresponding to the rifle bullet speed or type may be set adjacent to the appropriate verbal indicia of mode of game movement 28 instead of the particular game speed on scale 20. For example, if the game is running at a moderate pace, the position on projectile scale 24 corresponding to the rifle bullet speed or type is aligned with the midpoint of the "run" segment of target speed scale 20.

A sample calculation of lead is illustrated in FIGS. 2 and 3 for a target moving at 20 miles per hour at a 45° angle to the line of sight, a target range of 500 yards, and a projectile speed of 3500 feet per second. As shown in FIG. 2, projectile scale 24 at 3500 feet/second is aligned with game speed scale 20 at 20 mph. 12.6 Feet is then noted on lead scale 26 adjacent to 500 yards on range scale 18. Index 30 is then aligned with the 12.6 feet mark on lead scale 26 and the required lead of 8.9 feet is read on the lead scale 26 adjacent the 45° mark on direction scale 22, as shown in FIG. 3.

The above-described calculation will be an accurate reflection of required lead assuming that the speed of the projectile and the speed and direction of the target remain constant and the calculated range reflects the total distance traveled by the projectile before reaching the target, if the logarithmic scales 18, 20, 22, 24 and 26 have correlated proportions, so that the two slide steps described above accomplish a multiplication and a division followed by a multiplication which marks the point on lead scale 26 representing the target speed times the target range times the sine of the angle defining the target direction, divided by the projectile speed. The arrangements of logarithmic scales which permit successive multiplications and divisions to be carried out on a slide rule type calculator are well known in the calculator art and all such arrangements are deemed to be within the scope of the present invention.

Figure 6:
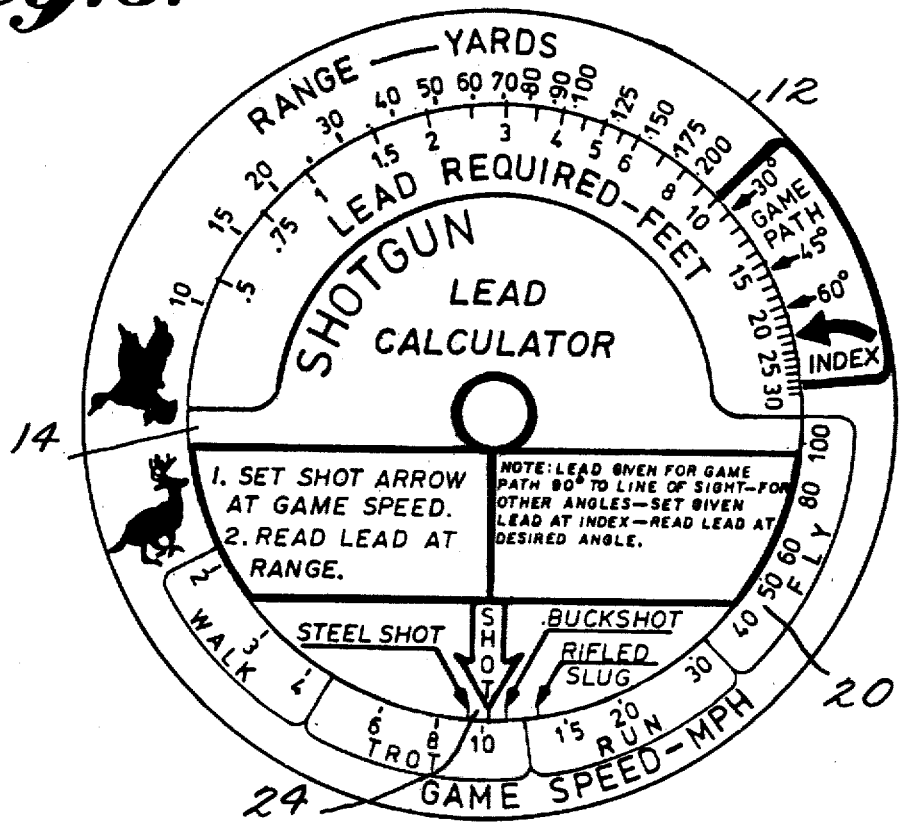
FIG. 6 illustrates the indicia on a second embodiment of the invention.

FIG. 6 illustrates a lead calculator in accordance with the present invention which is particularly useful for calculating the required lead when shooting with a shotgun. This embodiment is similar to the rifle embodiment except that the projectile scale 24 has disposed adjacent thereto word indicia descriptive of different kinds of shot pointing to locations on projectile scale 24 which correspond to the speed at which the various kinds of shot are fired from a shotgun. Since shotguns are utilized for duck hunting, the game speed scale 20 has been extended to include a segment of higher rates of speed identified by the word indicia "fly."

Figure 7:
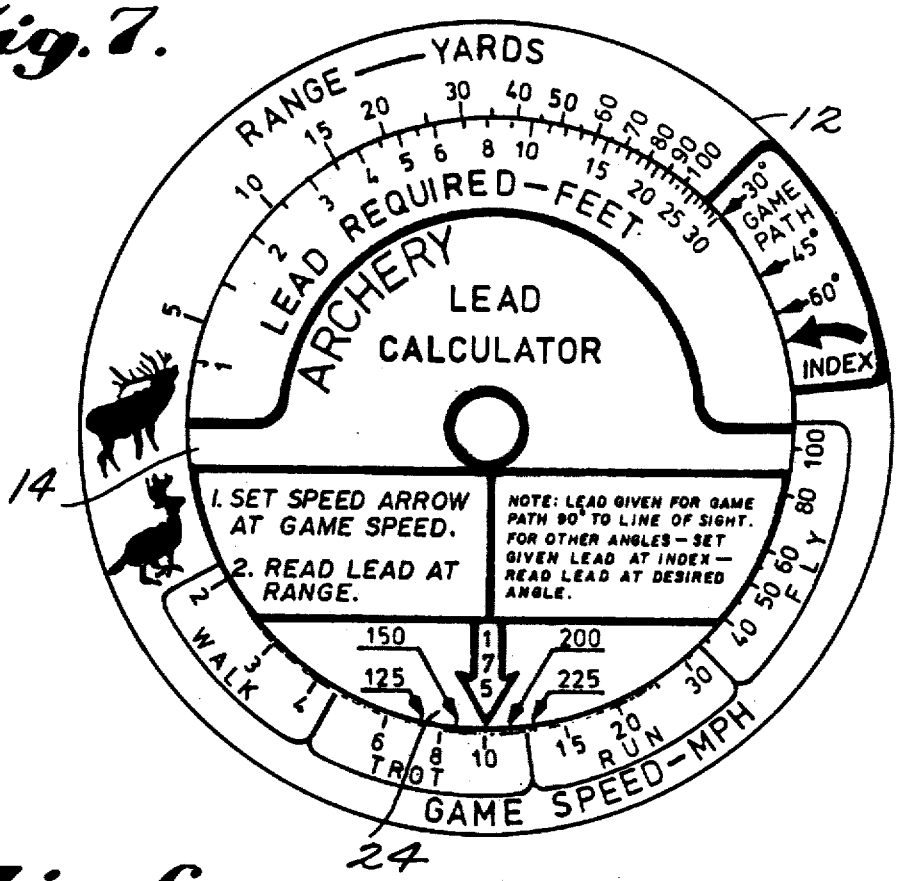
FIG. 7 illustrates the indicia on a third embodiment of the invention.

FIG. 7 shows an embodiment of the present invention particularly adapted for use by an archer or in calculating required lead for shooting at moving targets. This embodiment is similar to that shown in FIG. 6 except that projectile scale 24 has disposed adjacent thereto numerical indicia of common arrow speeds together with markers pointing to the corresponding speeds on the scale 24.

Although three particular embodiments of the invention have been disclosed in detail above, for illustrative purposes, it will be understood that variations and modifications of the disclosure which lie within the scope of the appended claims are fully contemplated. For example, the lead calculator may be enlarged and word, numeric and/or pictorial indicia of several types of weaponry may be appropriately marked on projectile scale 24 so that a single lead calculator may be used for calculating lead when using a variety of types of weapons. It will also be appreciated by those skilled in the art, that various other calculating devices such as nanograms and slide charts can be adapted to make similar calculations of lead by using properly arranged logarithmic scales and indicia as described hereinabove.

What is claimed is:

1. A device for calculating the required lead when shooting a projectile at a moving target, as a function of target speed, target range, projectile speed and the direction of movement of the target, comprising:

five scales including:

a first logarithmic scale having indicia associated therewith representing the speed of the target;

a second logarithmic scale having numerical indicia associated therewith representing the required lead;

a third logarithmic scale having numerical indicia associated therewith representing target range;

a fourth logarithmic scale having indicia associated therewith representing projectile speed; and a fifth logarithmic scale having indicia associated therewith representing the direction of movement of the target relative to the direction of movement of the projectile;

said first, second, third, fourth and fifth scales being formed on at least one member and disposed in physical proximity with each other so that they are correlated, the correlated numerical value associated with one of the scales being readily determinable if the correlated numerical value associated with each of the other four scales is known.

2. A device as in claim 1 wherein said fifth logarithmic scale comprises a scale of the logarithm of the sine of the angle between the direction of movement of the target and the direction of movement of the projectile.

3. A device as in claim 2 wherein said at least one member includes a first member, and a second member movable in relation to said first member, said first, third scales and fifth scales being formed on said first member, said second and fourth scales being formed on said second member.

4. A device as in claim 3 wherein said second member is mounted to said first member for rotation about a common axis, said first through fifth scales being formed in concentric arcs about said common axis.

5. A device as in claim 1 wherein said at least one member includes a first member and a second member, at least a first two of said five scales being formed on said first member and at least a second two of said scales being formed on said second member.

6. A device as in claim 1 or claim 5 further comprising a plurality of projectile indicia each descriptive of a different common type of projectile for shooting from a given type of weapon;

each of said plurality of projectile indicia being correlated with a particular location of said fourth scale, said particular location corresponding to the speed at which said each type of projectile is normally fired by said given type of weapon, so that the required lead may be readily determined even if the projectile speed is not known, if the projectile type is known.

7. A device as in claim 1 wherein said target comprises game, said device further comprising mode indicia formed on said first scale for indicating modes of movement of said game, such as walking, trotting, running and flying, said mode indicia being correlated to separate segments of said first scale corresponding to the ranges of speed within which said game normally moves when traveling in a corresponding mode.

8. A device as in claim 6 wherein said target comprises game, said device further comprising mode indicia formed on said first scale for indicating modes of movement of said game, such as walking, trotting, running and flying, said mode indicia being correlated to separate segments of said first scale corresponding to the ranges of speed within which said game normally moves when traveling in a corresponding mode.

9. A device as in claim 6 wherein said type of weapon comprises a rifle, said projectile comprises a bullet and said projectile indicia comprise alpha-numeric or numeric indicia of the caliber of said bullet.

10. A device as in claim 6 wherein said type of weapon comprises a shotgun, said projectile comprises shot, and said projectile indicia comprise word indicia of different types of shot.

11. A device as in claim 6 wherein said type of weapon comprises a bow, said projectile comprises an arrow and said projectile indicia comprise numeric indicia of the speed at which different types of arrows are normally shot.

12. A device as in claim 1 further comprising a projectile indicum descriptive of a particular type of projectile for shooting from a given type of weapon; said indicum being correlated with a particular location on said fourth scale at which said type of projectile is normally fired by said given type of weapon.

13. A device as in claim 4 wherein said first and second members respectively comprise first and second plastic discs, the diameter of said first disc being equal to the diameter of said second disc, said second disc having transparent portions for viewing said first, third and fifth scales therethrough.

14. A method for calculating the required lead when shooting a projectile at a moving target, as a function of four parameters, the parameters being target speed, target range, projectile speed, and the angle between the line of defining the flight line of the projectile and the line defining the direction of movement of the target, utilizing a calculator comprising at least five scales including a first scale having corresponding indicia of target speed, a second logarithmic scale having corresponding indicia designating quantitative representations of target range, a third logarithmic scale having corresponding indicia of projectile speed, a fourth logarithmic scale having corresponding indicia designating quantitative representations of required lead and a logarithmic sine scale having quantitative representations of the angle of movement of the target; the calculator further comprising a first member and a second member slidable in relation to said first member, two of said first through fifth scales being disposed on said first member and the remaining three of said first through fifth scale being disposed on said second member, said first through fifth scales being structurally correlated; said method comprising the step of:

sliding said second member in relation to said first member twice in order to determine the product of the target speed, the target range and the sine of the angle of movement of the target divided by the projectile speed.

15. A method as in claim 14 wherein said step of twice moving said second member includes the steps of:

(1) sliding said second member in relation to said first member so as to determine a first point on said fourth scale corresponding to a first value equal to the required lead when the target direction angle is equal to 90°; and (2) sliding said second member in relation to said first member to align a given point on said fifth scale with said first point in order to determine a value equal to said first value multiplied by the sine of the angle of movement of the target.

16. A method of calculating required lead as in claim 15 wherein said projectile has a known speed when shot from a firearm and said step (1) comprises the step of aligning a point on said third scale premarked to correspond to said known speed with another point on one of said first, second and fourth scales.

17. A method as in claim 16 wherein said projectile is a bullet and said third scale is premarked with a designation of the caliber of several known types of bullets.

18. A method as in claim 15 or claim 16 wherein said first scale has marked thereon a designated plurality of ranges of speed of the target, and verbal indicia, correlated to said ranges corresponding to modes of movement of said target, such as "walking," "trotting," "running" and "flying," said step (1) including the step of aligning a point on said first scale within the ranges of speed corresponding to the actual mode of movement of said target with a point on one of the second and fourth scales.

* * * * *